US010325564B2

(12) United States Patent
Park et al.

(10) Patent No.: US 10,325,564 B2
(45) Date of Patent: Jun. 18, 2019

(54) CLOCK GENERATION CIRCUIT HAVING OVER-CURRENT PROTECTING FUNCTION, METHOD OF OPERATING THE SAME AND DISPLAY DEVICE

(71) Applicant: Samsung Display Co., Ltd., Yongin-si, Gyeonggi-do (KR)

(72) Inventors: Yoonsik Park, Yongin-si (KR); Kyunho Kim, Cheonan-si (KR); Yu-chol Kim, Pyeongtaek-si (KR); Jongjae Lee, Hwaseong-si (KR); Jiye Lee, Suwon-si (KR); Youngsuk Jung, Iksan-si (KR); Hyehyun Jeong, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 378 days.

(21) Appl. No.: 15/365,292

(22) Filed: Nov. 30, 2016

(65) Prior Publication Data

US 2017/0206847 A1 Jul. 20, 2017

(30) Foreign Application Priority Data

Jan. 19, 2016 (KR) ..... 10-2016-0006611

(51) Int. Cl.
*G09G 3/36* (2006.01)

(52) U.S. Cl.
CPC ..... *G09G 3/3677* (2013.01); *G09G 3/3688* (2013.01); *G09G 2310/08* (2013.01); *G09G 2330/04* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,692,757 | B2 * | 4/2014 | Bang | G09G 3/3648 345/100 |
| 2015/0194800 | A1 * | 7/2015 | Kim | G09G 3/3677 361/95 |
| 2017/0256222 | A1 * | 9/2017 | Kuo | G09G 3/3677 |

FOREIGN PATENT DOCUMENTS

| | | | |
|---|---|---|---|
| KR | 10-0363095 | B1 | 12/2002 |
| KR | 10-1385206 | B1 | 4/2014 |
| KR | 10-2015-0081867 | A | 7/2015 |
| KR | 10-1579842 | B1 | 12/2015 |

* cited by examiner

*Primary Examiner* — Robin J Mishler
(74) *Attorney, Agent, or Firm* — Lewis Roca Rothgerber Christie LLP

(57) ABSTRACT

A clock generation circuit includes: a clock generator to receive a gate pulse signal and to generate at least one gate clock signal corresponding to the gate pulse signal; an over-current protector to detect a current level of the at least one gate clock signal, and to output a shutdown enable signal and at least one switching signal corresponding to the detected current level; and a switching unit including at least one switching device to output the gate pulse signal as the at least one gate clock signal. The clock generator is to generate the at least one gate clock signal in response to the shutdown enable signal, and the at least one switching device is to transmit the gate pulse signal as the at least one gate clock signal in response to the at least one switching signal.

19 Claims, 9 Drawing Sheets

CLOCK GENERATION CIRCUIT HAVING OVER-CURRENT PROTECTING FUNCTION, METHOD OF OPERATING THE SAME AND DISPLAY DEVICE

CROSS-REFERENCE TO RELATED APPLICATION

This application claims priority to and the benefit of Korean Patent Application No. 10-2016-0006611, filed on Jan. 19, 2016, in the Korean Intellectual Property Office (KIPO), the entire content of which is incorporated herein by reference.

BACKGROUND

1. Field

One or more aspects of example embodiments of the present disclosure relate to a clock generation circuit having an over-current protecting function, a method of operating the same, and a display device including the same.

2. Description of the Related Art

In general, a display device includes a display panel for displaying an image and a driving circuit for driving the display panel. The display panel includes a plurality of gate lines, a plurality of data lines, and a plurality of pixels. Each of the pixels includes a thin film transistor, a liquid crystal capacitor, and a storage capacitor. The driving circuit includes a data driving circuit for outputting driving signals to data lines, a gate driving circuit for outputting gate driving signals for driving gate lines, a clock generation circuit for providing gate clock signals to the gate driving circuit, and a timing controller for controlling the data driving circuit and the gate driving circuit.

The display device may apply a gate on voltage to a gate electrode of the thin film transistor connected to a corresponding gate line to be selected for displaying an image, and may apply a data voltage corresponding to a display image to a source electrode of the thin film transistor to display the image.

When the display panel and/or the gate driving circuit are damaged, over-current may be introduced into the display panel and/or the gate driving circuit by the clock signal transmitted from the clock generation circuit.

The above information disclosed in this Background section is for enhancement of understanding of the background of the inventive concept, and therefore, it may contain information that does not constitute prior art.

SUMMARY

One or more aspects of example embodiments of the present disclosure are directed toward a clock generation circuit having an over-current protecting function.

One or more aspects of example embodiments of the present disclosure are directed toward a method of operating a clock generation circuit having an over-current protecting function.

One or more aspects of example embodiments of the present disclosure are directed toward a display device including a clock generation circuit having an over-current protecting function.

According to an example embodiment of the inventive concept, a clock generation circuit includes: a clock generator configured to receive a gate pulse signal and to generate at least one gate clock signal corresponding to the gate pulse signal; an over-current protector configured to detect a current level of the at least one gate clock signal, and to output a shutdown enable signal and at least one switching signal corresponding to the detected current level; and a switching unit including at least one switching device configured to output the gate pulse signal as the at least one gate clock signal, wherein the clock generator is configured to generate the at least one gate clock signal in response to the shutdown enable signal, and the at least one switching device is configured to transmit the gate pulse signal as the at least one gate clock signal in response to the at least one switching signal.

The over-current protector may be configured to activate the shutdown enable signal when the detected current level is greater than a reference level.

The clock generator may be configured to stop the generation of the at least one gate clock signal when the shutdown enable signal is activated.

The over-current protector may be configured to activate the at least one switching signal when the shutdown enable signal is activated.

The clock generator may be configured to receive the gate pulse signal to generate a pair of gate clock signals corresponding to the gate pulse signal.

The over-current protector may be configured to output a plurality of switching signals corresponding to the detected current level, and the switching signals may respectively correspond to the pair of gate clock signals.

The over-current protector may be configured to sequentially activate the switching signals, when the detected current level exceeds a reference level.

The at least one switching device may include a transistor including a first electrode connected to receive the gate pulse signal, a second electrode connected to receive the at least one gate clock signal, and a gate electrode connected to receive the at least one switching signal.

According to an example embodiment of the inventive concept, a method of operating a clock generation circuit includes: receiving a gate pulse signal to generate a gate clock signal; detecting a current level of the gate clock signal; stopping the generation of the gate clock signal in response to the current level of the gate clock signal being greater than a reference level; activating a switching signal in response to the current level of the gate clock signal being greater than the reference level; and outputting the gate pulse signal as the gate clock signal in response to the switching signal.

The method may further include activating a shutdown enable signal in response to the current level of the gate clock signal being greater than the reference level.

The stopping of the generation of the gate clock signal may include stopping the generation of the gate clock signal in response to the shutdown enable signal being activated.

According to an example embodiment of the inventive concept, a display device includes: a display panel including a plurality of pixels connected to a plurality of gate lines and a plurality of data lines, respectively; a gate driving circuit configured to drive the plurality of gate lines; a data driving circuit configured to drive the plurality of data lines; and a driving controller configured to control the data driving circuit in response to a control signal and an image signal, and to generate at least one gate clock signal for operating the gate driving circuit, wherein the driving controller includes: a timing controller configured to generate a gate pulse signal in response to the control signal; and a clock generation circuit configured to generate the at least one gate clock signal in response to the gate pulse signal, and wherein the clock generation circuit is configured to detect a current level of the at least one gate clock signal, to stop the generation of the at least one gate clock signal when the detected current level is greater than a reference level, and to output the gate pulse signal as the at least one gate clock signal.

The clock generation circuit may include: a clock generator configured to receive the gate pulse signal and to generate the at least one gate clock signal corresponding to the gate pulse signal; an over-current protector configured to detect a current level of the at least one gate clock signal, to activate a shutdown enable signal and at least one switching signal when the detected current level is greater than the reference level; and a switching unit including at least one switching device configured to output the gate pulse signal as the at least one gate clock signal. The clock generator may be configured to generate the at least one gate clock signal in response to the shutdown enable signal, and the at least one switching element may be configured to transmit the gate pulse signal as the at least one gate clock signal in response to the at least one switching signal.

The clock generator may be configured to stop the generation of the at least one gate clock signal when the shutdown enable signal is activated.

The over-current protector may be configured to activate the at least one switching signal when the shutdown enable signal is activated.

The clock generator may be configured to receive the gate pulse signal to generate a pair of gate clock signals corresponding to the gate pulse signal.

The over-current protector may be configured to output a plurality of switching signals corresponding to the detected current level, and the switching signals may respectively correspond to the pair of gate clock signals.

The switching signals may be sequentially activated, when the detected current level exceeds the reference level.

The at least one switching device may include a transistor including a first electrode connected to receive the gate pulse signal, a second electrode connected to receive the at least one gate clock signal, and a gate electrode connected to receive the at least one switching signal.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept, and together with the description, serve to describe aspects and features of the inventive concept. In the drawings.

DETAILED DESCRIPTION

Figure 1:
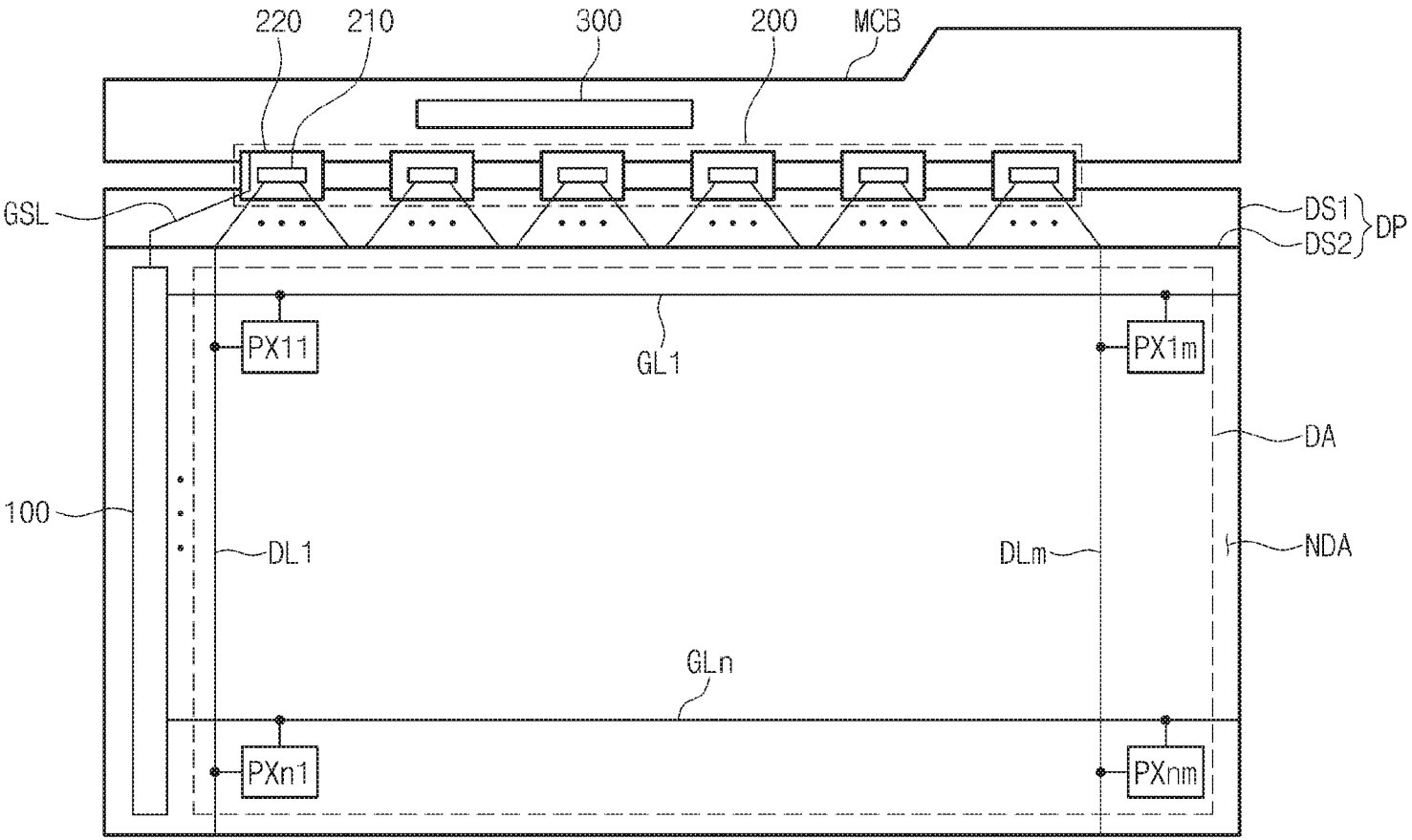
FIG. 1 is a plan view of a display device according to an embodiment of the inventive concept.

Hereinafter, example embodiments will be described in more detail with reference to the accompanying drawings. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a plan view of a display apparatus according to an embodiment of the inventive concept.

Referring to FIG. 1, a display device according to an embodiment of the inventive concept includes a display panel DP, a gate driving circuit 100, a data driving circuit 200, and a driving controller 300.

The display panel DP is not particularly limited. For example, the display panel DP may include various display panels, such as a liquid crystal display panel, an organic light emitting display panel, an electrophoretic display panel, and/or an electrowetting display panel. For convenience, the display panel DP may be described hereinafter as a liquid crystal display panel. A liquid crystal display device including the liquid crystal display panel may further include a polarizer and a backlight unit (e.g., a backlight or a backlight source).

The display panel DP includes a first substrate DS1, a second substrate DS2 spaced from the first substrate DS1, and a liquid crystal layer (LCL) disposed between the first substrate DS1 and the second substrate DS2. The display panel DP includes a display area DA on which a plurality of pixels PX11 to PXnm are disposed, and a non-display area NDA surrounding the display area DA.

The display panel DP includes a plurality of gate lines GL1 to GLn disposed on the first substrate DS1, and a plurality of data lines DL1 to DLm crossing the gate lines GL1 to GLn. The plurality of gate lines GL1 to GLn are connected to the gate driving circuit 100. The plurality of data lines DL1 to DLm are connected to the data driving circuit 200. For convenience, FIG. 1 illustrates only some of the plurality of gate lines GL1 to GLn and only some of the plurality of data lines DL1 to DLm.

For convenience, FIG. 1 illustrates only some of the plurality of pixels PX11 to PXnm. The plurality of pixels PX11 to PXnm are connected to corresponding gate lines of the plurality of gate lines GL1 to GLn and corresponding data lines of the plurality of data lines DL1 to DLm, respectively.

The plurality of pixels PX11 to PXnm may be classified into a plurality of groups according to colors to be displayed. The plurality of pixels PX11 to PXnm may display any one of primary colors. The primary colors may include red, green, blue, and/or white colors. However, the inventive concept is not limited thereto. For example, the primary colors may include various colors, such as yellow, cyan, and/or magenta.

Figure 2:
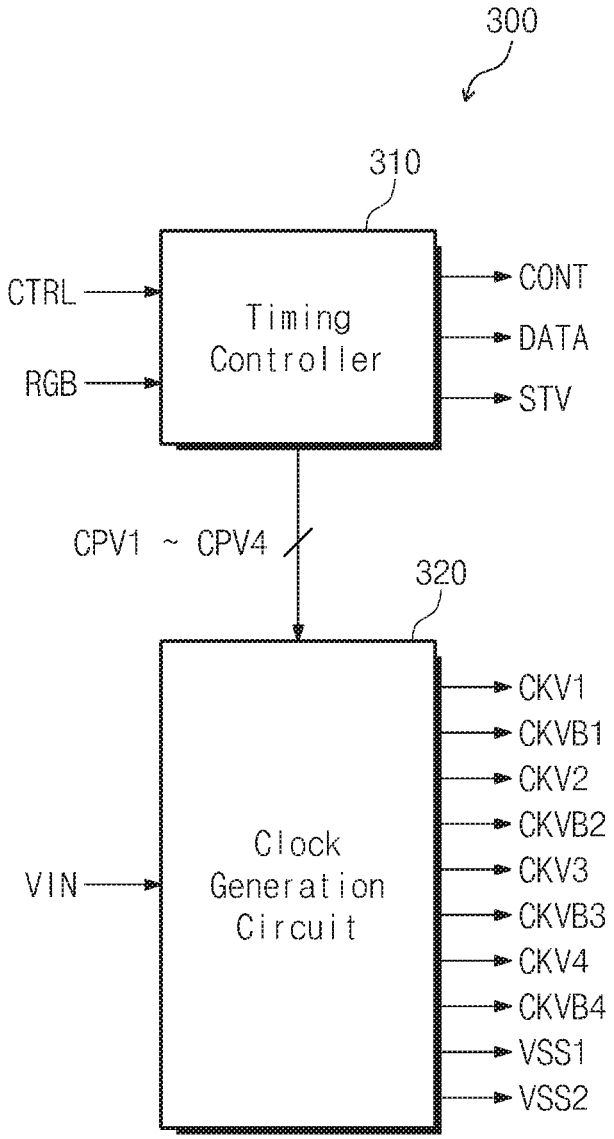
FIG. 2 is a block diagram illustrating an example of a driving controller of FIG. 1.
Figure 3:
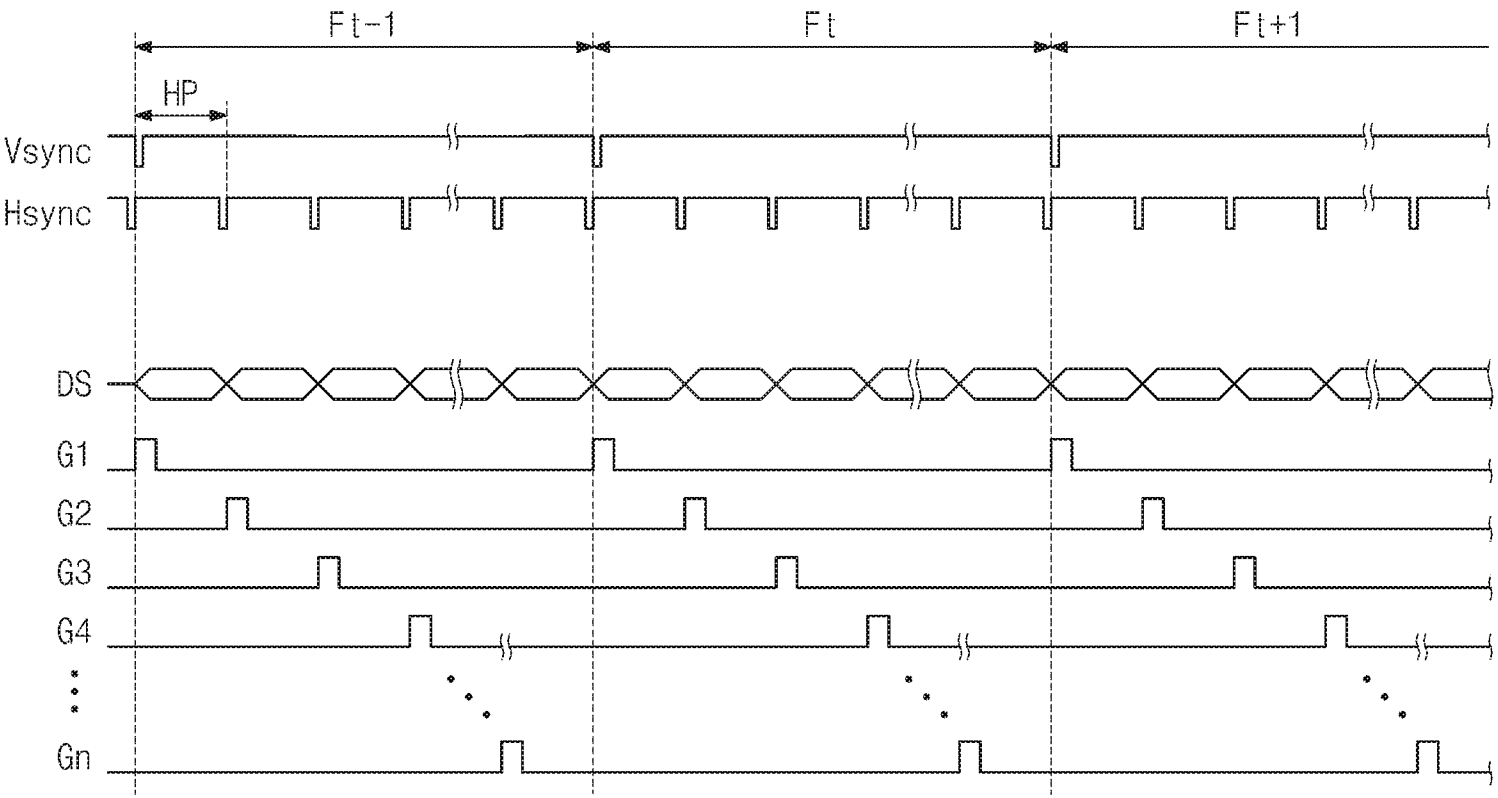
FIG. 3 is a timing diagram of signals of a display device according to an embodiment of the inventive concept.

FIG. 2 is a block diagram illustrating an example of the driving controller of FIG. 1. FIG. 3 is a timing diagram of signals of the display device according to an embodiment of the inventive concept.

Referring to FIGS. 1, 2, and 3, the driving controller 300 may be mounted on a main circuit board MCB. The driving controller 300 receives image data RGB and a control signal CTRL from an external graphic control unit (e.g., an external graphic controller). The control signal CTRL may include a vertical synchronization signal Vsync which is a signal for distinguishing frame periods Ft−1, Ft, and Ft+1, a horizontal synchronization signal Hsync which is a signal for distinguishing horizontal periods HP (e.g., a row discrimination signal), a data enable signal (e.g., having a high level during only a period for which data is outputted to display a data input section), and a clock signal.

The driving controller 300 includes a timing controller 310 and a clock generation circuit 320. The timing controller 310 receives the image data RGB and the control signal CTRL, to output a data control signal CONT and a data signal DATA to be supplied to the data driving circuit 200, a start signal STV to be supplied to the gate driving circuit 100, and a gate pulse signal CPV (e.g., CPV1 to CPV4) to be supplied to the clock generation circuit 320.

The clock generation circuit 320 receives gate pulse signals CPV1 to CPV4 from the timing controller 310, to generate gate clock signals CKV1 to CKV4 and CKVB1 to CKVB4, a first voltage (e.g., a first low voltage or a first ground voltage) VSS1, and a second voltage (e.g., a second low voltage or a second ground voltage) VSS2. Although the clock generation circuit 320 is shown as receiving four gate pulse signals CPV1 to CPV4 to output eight gate clock signals CKV1 to CKV4 and CKVB1 to CKVB4 as an example, the inventive concept is not limited thereto. For example, a number of gate pulse signals and gate clock signals may be variously changed. The clock generation circuit 320 may receive an input voltage VIN from the outside.

A power management integrated circuit (PMIC) may be realized as the clock generation circuit 320. The first voltage VSS1 and the second voltage VSS2, which are generated by the clock generation circuit 320, may have voltage levels that are different from each other. The first voltage VSS1 and the second voltage VSS2 may be provided to the gate driving circuit 100 of FIG. 1.

The gate driving circuit 100 generates gate signals G1 to Gn on the basis of the start signal STV, the gate clock signals CKV1 to CKV4 and CKVB1 to CKVB4, the first voltage VSS1, and the second voltage VSS2, which are received through the signal line GSL from the driving controller 300 during the frame periods Ft−1, Ft, and Ft+1, to output the gate signals G1 to Gn to the plurality of gate lines GL1 to GLn. The gate signals G1 to Gn may be sequentially (e.g., successively) outputted to correspond to the horizontal periods HP. The gate driving circuit 100 may be concurrently (e.g., simultaneously) formed together with the pixels PX11 to PXnm through a thin film process. For example, the gate driving circuit 100 may be mounted on the non-display area NDA of the display panel DP in the form of an oxide semiconductor TFT gate driver circuit (OSG).

FIG. 1 illustrates an example of one gate driving circuit 100 connected to left ends of the plurality of gate lines GL1 to GLn. However, according to another embodiment of the inventive concept, the display apparatus 100 may include two gate driving circuits. One of the two gate driving circuits may be connected to the left ends of the plurality of gate lines GL1 to GLn, the other one of the two gate driving circuits may be connected to right ends of the plurality of gate lines GL1 to GLn. Also, one of the two gate driving circuits may be connected to odd-numbered gate lines, and the other one of the two gate driving circuits may be connected to even-numbered gate lines.

The data driving circuit 200 generates gray level voltages according to the data signal DATA provided from the driving controller 300 on the basis of the data control signal CONT received from the driving controller 300. The data driving circuit 200 outputs the gray level voltages to the plurality of data lines DL1 to DLm as data voltages DS.

The data voltages DS may include positive data voltages (each of which has a positive value) and/or negative data voltages (each of which has a negative value) with respect to a common voltage. Some of the data voltages applied to the data lines DL1 to DLm during each of the horizontal periods HP may have a positive polarity, and others of the data voltages may have a negative polarity. The polarities of the data voltages DS may be inverted according to the frame periods Ft−1, Ft, and Ft+1 to prevent or substantially prevent a liquid crystal from being degraded. The data driving circuit 200 may generate the data voltages DS inverted by a frame period unit in response to an inversion signal.

The data driving circuit 200 may include a plurality of driving chips 210 and a plurality of flexible circuit boards 220 on which the plurality of driving chips 210 are respectively mounted. The flexible circuit boards 220 electrically connect the main circuit board MCB to the first substrate DS1. Each of the plurality of driving chips 210 provides a data signal to a corresponding data line of the plurality of data lines DL1 to DLm.

FIG. 1 illustrates an example of a tape carrier package (TCP)-type data driving circuit 200. In another embodiment of the inventive concept, the data driving chip 200 may be disposed on the non-display area NDA of the first substrate DS1 in a chip on glass (COG) manner.

Figure 4:
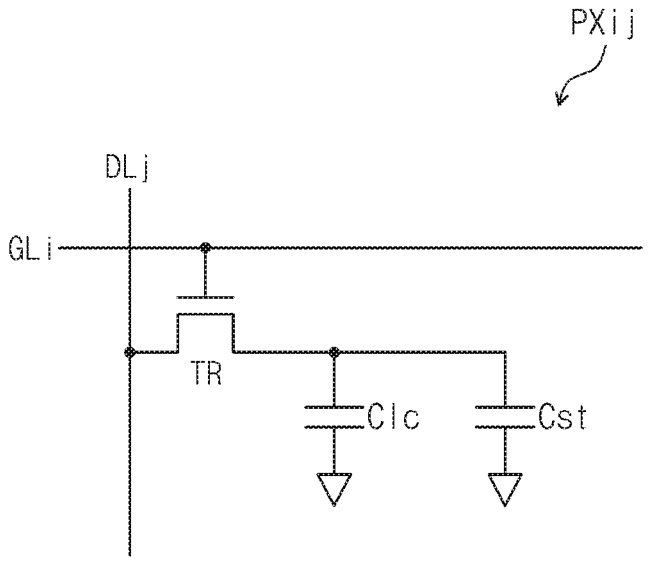
FIG. 4 is an equivalent circuit diagram of a pixel according to an embodiment of the inventive concept.
Figure 5:
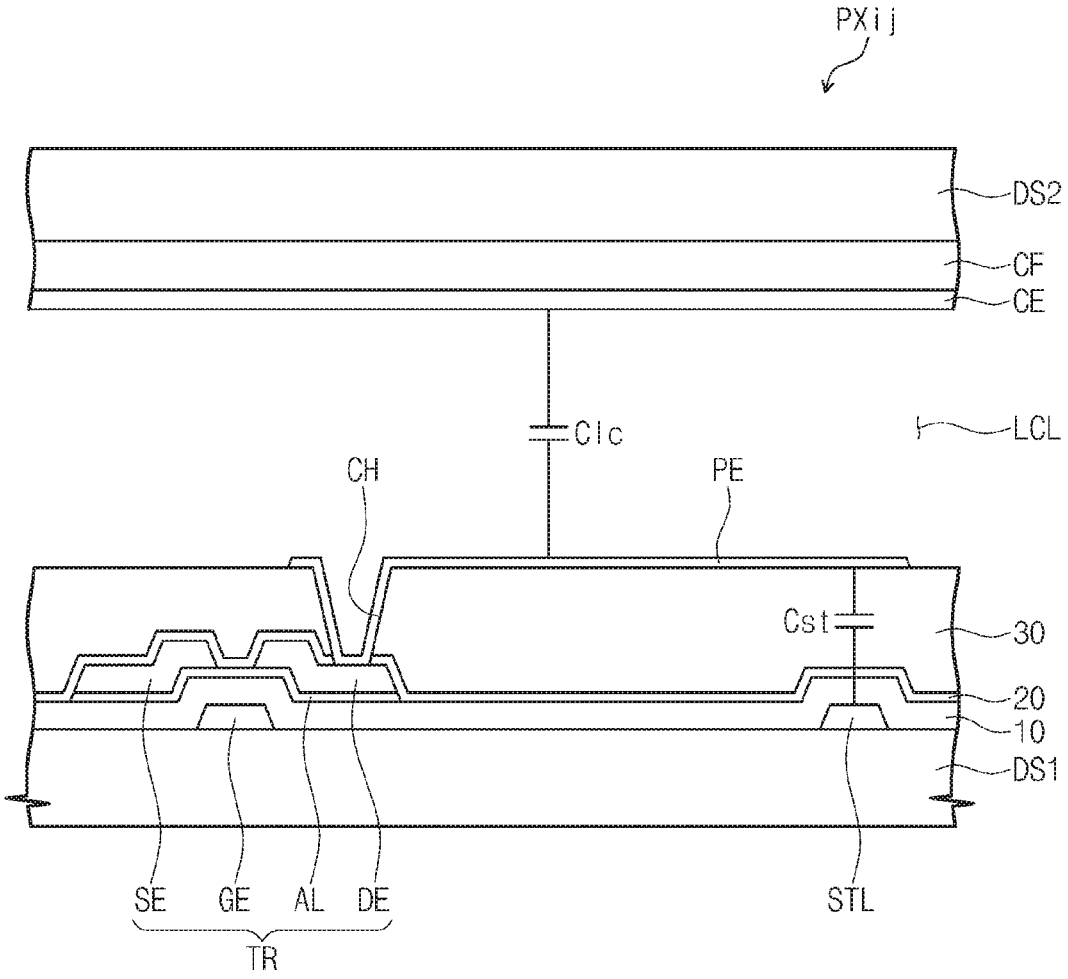
FIG. 5 is a cross-sectional view of the pixel according to an embodiment of the inventive concept.

FIG. 4 is an equivalent circuit diagram of a pixel according to an embodiment of the inventive concept. FIG. 5 is a cross-sectional view of the pixel according to an embodiment of the inventive concept. Each of the plurality of pixels PX11 to PXnm of FIG. 1 may have the same or substantially the same equivalent circuit as that of the pixel PXij shown in FIG. 4.

Referring to FIG. 4, the pixel PXij includes a pixel thin film transistor TR (hereinafter, referred to as a pixel transistor), a liquid crystal capacitor Clc, and a storage capacitor Cst. Hereinafter, the transistor in this specification may represent a thin film transistor. In an embodiment of the inventive concept, the storage capacitor Cst may be omitted.

The pixel transistor TR may be electrically connected to an i-th gate line GLi and a j-th data line DLj. The pixel transistor TR outputs a pixel voltage corresponding to a data signal received from the j-th data line DLj, in response to a gate signal received from the i-th gate line GLi.

The liquid crystal capacitor Clc is charged with the pixel voltage outputted from the pixel transistor TR. Liquid crystal directors contained in the liquid crystal layer LCL (e.g., see FIG. 5) may be changed in arrangement according to an amount of electric charges charged in the liquid crystal capacitor Clc. Depending on the arrangement of the liquid crystal directors, light incident into the liquid crystal layer may be transmitted or blocked.

The storage capacitor Cst is connected in parallel to the liquid crystal capacitor Clc. The storage capacitor Cst may maintain or substantially maintain the arrangement of the liquid crystal directors during a set or predetermined period.

As illustrated in FIG. 5, the pixel transistor TR includes a gate electrode GE connected to the i-th gate line GLi (e.g. see FIG. 4), an activation part AL overlapping with the gate electrode GE, a first electrode SE connected to the j-th data line DLj (e.g. see FIG. 4), and a second electrode DE disposed to be spaced from the first electrode SE.

The liquid crystal capacitor Clc includes a pixel electrode PE and a common electrode CE. The storage capacitor Cst includes the pixel electrode PE and a portion of a storage line STL overlapping with the pixel electrode PE.

The i-th gate line GLi and the storage line STL are disposed on a surface (e.g., one surface) of a first substrate DS1. The gate electrode GE is branched from the i-th gate line GLi. The i-th gate line GLi and the storage line STL may be formed of a metal, such as Al, Ag, Cu, Mo, Cr, Ta, and Ti, or an alloy thereof. The i-th gate line GLi and the storage line STL may include a multi-layered structure, e.g., a Ti layer and a Cu layer.

A first insulation layer 10 covering the gate electrode GE and the storage line STL is disposed on a surface (e.g., one surface) of the first substrate DS1. The first insulation layer 10 may include at least one of an inorganic material and an organic material. The first insulation layer 10 may be an organic layer or an inorganic layer. The first insulation layer 10 may include a multi-layered structure, for example, a silicon nitride layer and a silicon oxide layer.

The activation part AL overlapping with the gate electrode GE is disposed on the first insulation layer 10. The activation part AL may include a semiconductor layer and an ohmic contact layer. The semiconductor layer 10 may be disposed on the first insulation layer 10, and the ohmic contact layer may be disposed on the semiconductor layer.

The first electrode SE and the second electrode DE are disposed on the activation part AL. The second electrode DE and the first electrode SE are disposed to be spaced from each other. Each of the second electrode DE and the first electrode SE partially overlaps with the gate electrode GE.

A second insulation layer 20 covering the activation layer AL, the second electrode DE, and the first electrode SE, is disposed on the first insulation layer 10. The second insulation layer 20 may include at least one of an inorganic material and an organic material. The second insulation layer 20 may be an organic layer or an inorganic layer. The second insulation layer 20 may include a multi-layered structure, for example, a silicon nitride layer and a silicon oxide layer.

Although the pixel transistor TR having a staggered structure is illustrated as an example in FIG. 5, the structure of the pixel transistor TR is not limited thereto. For example, in another embodiment, the pixel transistor TR may have a planner structure.

A third insulation layer 30 is disposed on the second insulation layer 20. The third insulation layer 30 provides a planarization surface. The third insulation layer 30 may include an organic material.

The pixel electrode PE is disposed on the third insulation layer 30. The pixel electrode PE is connected to the second electrode DE through a contract hole CH passing through the second and third insulation layers 20 and 30. An alignment layer covering the pixel electrode PE may be disposed on the third insulation layer 30.

A color filter layer CF is disposed on a surface (e.g., one surface) of a second substrate DS2. The common electrode CE is disposed on the color filter layer CF. A common voltage is applied to the common electrode CE. The common voltage and the pixel voltage may have values that are different from each other. An alignment layer covering the common electrode CE may be disposed on the common electrode CE. Another insulation layer may be disposed between the color filter layer CF and the common electrode CE.

The pixel electrode PE and the common electrode CE disposed with the liquid crystal layer LCL therebetween may form the liquid crystal capacitor Clc. Also, a portion of the pixel electrode PE and the storage line STL, which are disposed with the first, second, and third insulation layers 10, 20, and 30 therebetween, may form the storage capacitor Cst. The storage line STL receives a storage voltage having a value different from that of the pixel voltage. The storage voltage may have the same or substantially the same value as that of the common voltage.

The cross-section of the pixel PXij of FIG. 5 may be merely an example. For example, unlike the structure of FIG. 5, at least one of the color filter layer CF and the common electrode CE may be disposed on the first substrate DS1. That is, the liquid crystal display panel according to an embodiment may include pixels, such as a vertical alignment (AV) mode pixel, a patterned vertical alignment (PVA) mode pixel, an in-plane switching (IPS) mode pixel, a fringe-field switching (FFS) mode pixel, and a plane to line switching (PLS) mode pixel.

Figure 6:
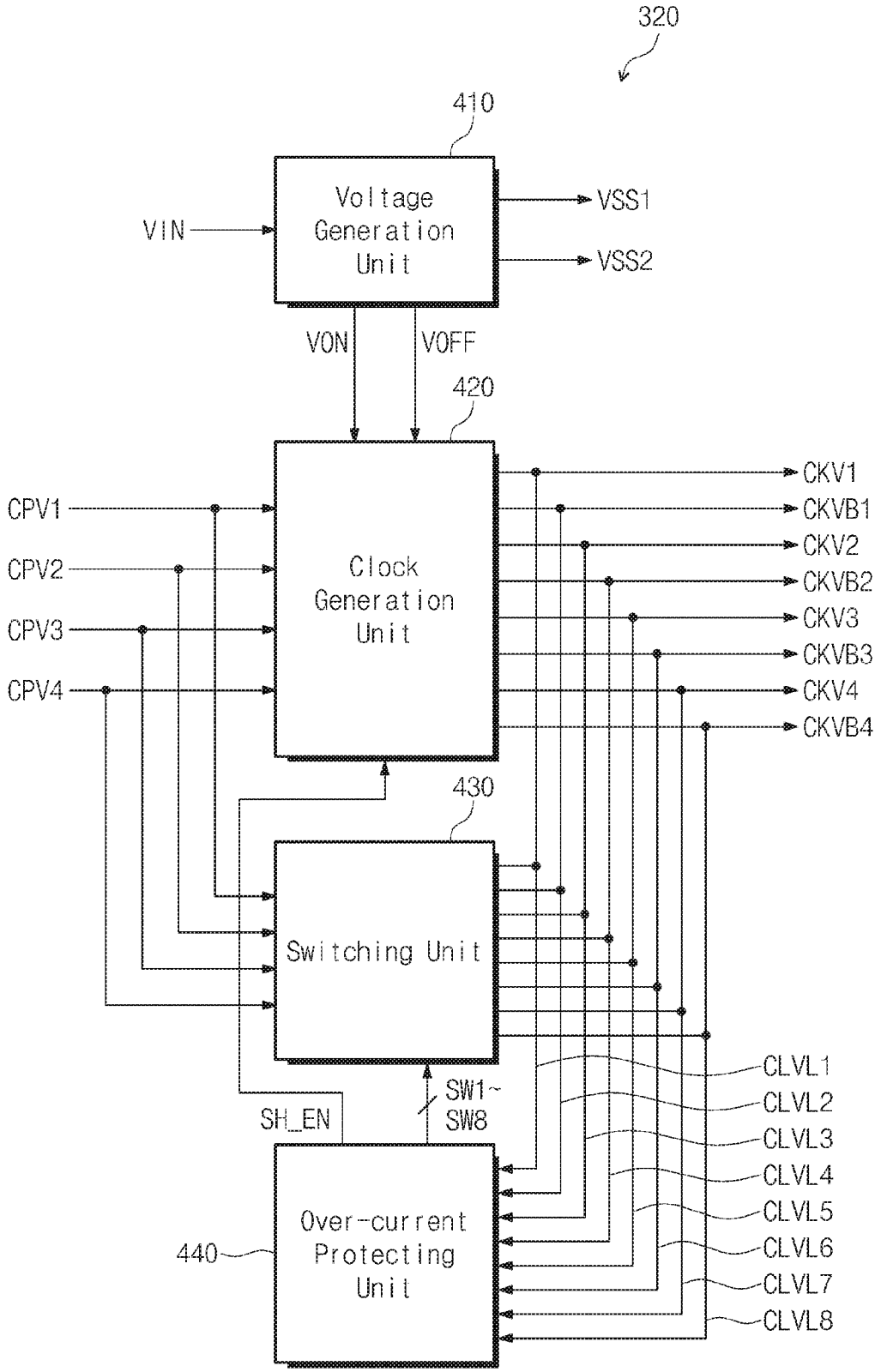
FIG. 6 is a block diagram illustrating an example of a clock generation circuit of FIG. 2.

FIG. 6 is a block diagram illustrating an example of the clock generation circuit of FIG. 2.

Referring to FIG. 6, the clock generation circuit 320 includes a voltage generation unit (e.g., a voltage generator) 410, a clock generation unit (e.g., a clock generator) 420, a switching unit 430, and an over-current protecting unit (e.g., an over-current protector) 440. The voltage generation unit 410 receives an input voltage VIN to generate the first voltage VSS1, the second voltage VSS2, a gate on voltage VON, and a gate off voltage VOFF. The voltage generation unit 410 may further generate a power voltage (e.g., an analog power voltage) that is used for operating the data driving circuit 200.

The clock generation unit 420 receives the gate on voltage VON and the gate off voltage VOFF from the voltage generation unit 410. The clock generation unit 420 inverts the gate pulse signals CPV1 to CPV4 transmitted from the timing controller 310 of FIG. 2 into gate clock signals CKV1, CKVB1, CKV2, CKVB2, CKV3, CKVB3, CKV4, and CKVB4. For example, the clock generation unit 420 outputs a pair of complementary gate clock signals CKV1 and CKVB1 on the basis of the gate pulse signal CPV1. The clock generation unit 420 outputs a pair of complementary gate clock signals CKV2 and CKVB2 on the basis of the gate pulse signal CPV2. The clock generation unit 420 outputs a pair of complementary gate clock signals CKV3 and CKVB3 on the basis of the gate pulse signal CPV3. The clock generation unit 420 outputs a pair of complementary gate clock signals CKV4 and CKVB4 on the basis of the gate pulse signal CPV4. The gate clock signals CKV1, CKVB1, CKV2, CKVB2, CKV3, CKVB3, CKV4, and CKVB4 may be signals that are swung between the gate on voltage VON and the gate off voltage VOFF. The gate clock signals CKV1, CKVB1, CKV2, CKVB2, CKV3, CKVB3, CKV4, and CKVB4 may be set to have phases that are different from each other during one period.

The switching unit 430 outputs the gate pulse signals CPV1 to CPV4 as the gate clock signals CKV1, CKVB1, CKV2, CKVB2, CKV3, CKVB3, CKV4, and CKVB4 in response to switching signals SW1 to SW8 transmitted from the over-current protecting unit 440.

The over-current protecting unit 440 detects current levels of gate clock signal lines CLVL1 to CLVL8 to which the gate clock signals CKV1, CKVB1, CKV2, CKVB2, CKV3, CKVB3, CKV4, and CKVB4 are provided, and outputs the switching signals SW1 to SW8 according to the detected current levels. For example, when the current levels of the gate clock signal lines CLVL1 to CLVL 8 are less than a reference level, the switching signals SW1 to SW8 each having a low level are outputted. If at least one current level of the gate clock signal lines CLVL1 to CLVL8 is greater than the reference level, the switching signals SW1 to SW8 are sequentially (e.g., successively) outputted at a high level.

The over-current protecting unit 440 outputs a shutdown enable signal SH_EN to the clock generation unit 420. When the current levels of the gate clock signal lines CLVL1 to CLVL8 are less than the reference level, the shutdown enable signal SH_EN having a low level is outputted. When at least one current level of the gate clock signal lines CLVL1 to CLVL8 is greater than the reference level, the shutdown enable signal SH_EN having a high level is outputted.

The clock generation unit 420 inverts the gate pulse signals CPV1 to CPV4 into the gate clock signals CKV1, CKVB1, CKV2, CKVB2, CKV3, CKVB3, CKV4, and CKVB4 while the shutdown enable signal SH_EN has the low level. When the shutdown enable signal SH_EN has the high level, the clock generation unit 420 stops the output of the gate clock signals CKV1, CKVB1, CKV2, CKVB2, CKV3, CKVB3, CKV4, and CKVB4.

Figure 7:
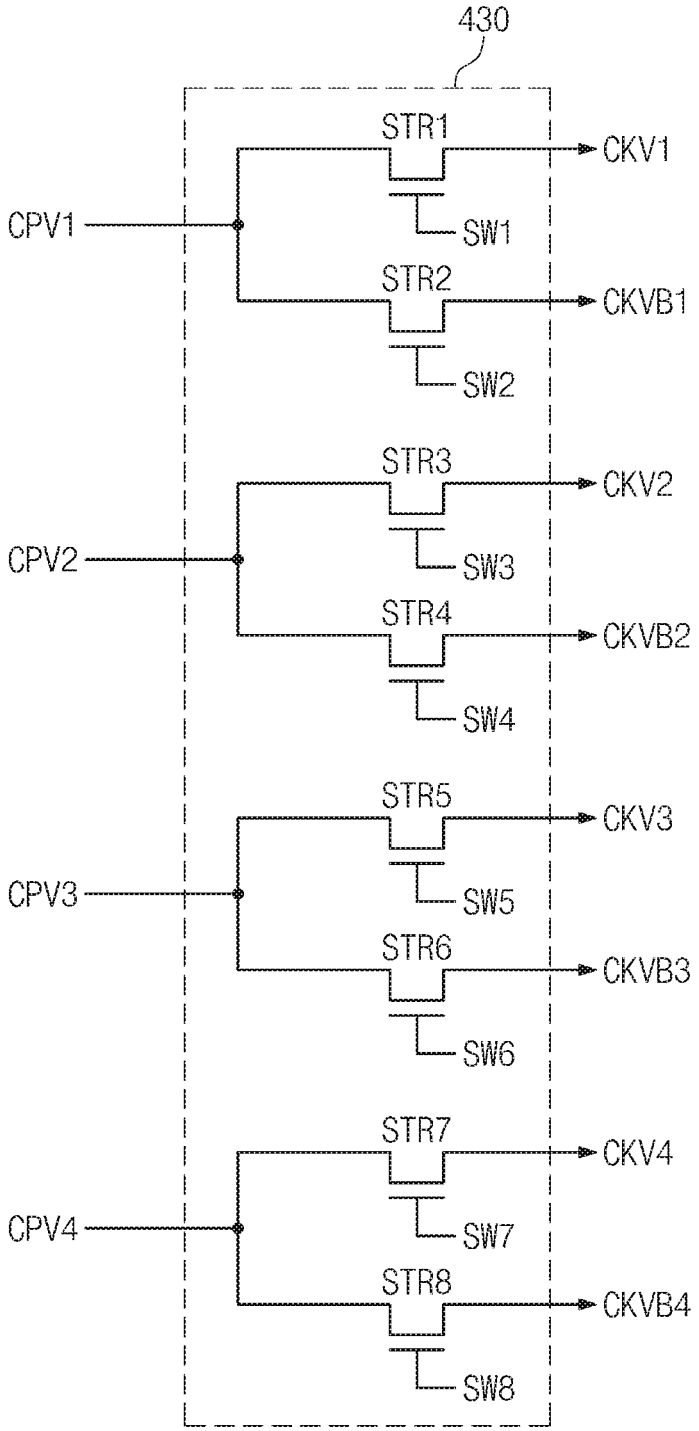
FIG. 7 is a circuit diagram illustrating an example of a switching unit of FIG. 6.

FIG. 7 is a circuit diagram illustrating an example of the switching unit of FIG. 6.

Referring to FIG. 7, the switching unit 430 includes switching transistors STR1 to STR8. The switching transistors STR1 to STR8 correspond to the gate clock signals CKV1, CKVB1, CKV2, CKVB2, CKV3, CKVB3, CKV4, and CKVB4, respectively. Also, the switching transistors STR1 to STR8 correspond to the switching signals SW1 to SW8, respectively, which are transmitted from the over-current protecting unit 440 of FIG. 6.

The switching transistors STR1 and STR2 output the gate pulse signal CPV1 as the gate clock signals CKV1 and CKVB1, in response to the corresponding switching signals SW1 and SW2. The switching transistors STR3 and STR4 output the gate pulse signal CPV2 as the gate clock signals CKV2 and CKVB2, in response to the corresponding switching signals SW3 and SW4. The switching transistors STR5 and STR6 output the gate pulse signal CPV3 as the gate clock signals CKV3 and CKVB3, in response to the corresponding switching signals SW5 and SW6. The switching transistors STR7 and STR8 output the gate pulse signal CPV4 as the gate clock signals CKV4 and CKVB4, in response to the corresponding switching signals SW7 and SW8.

Figure 8:
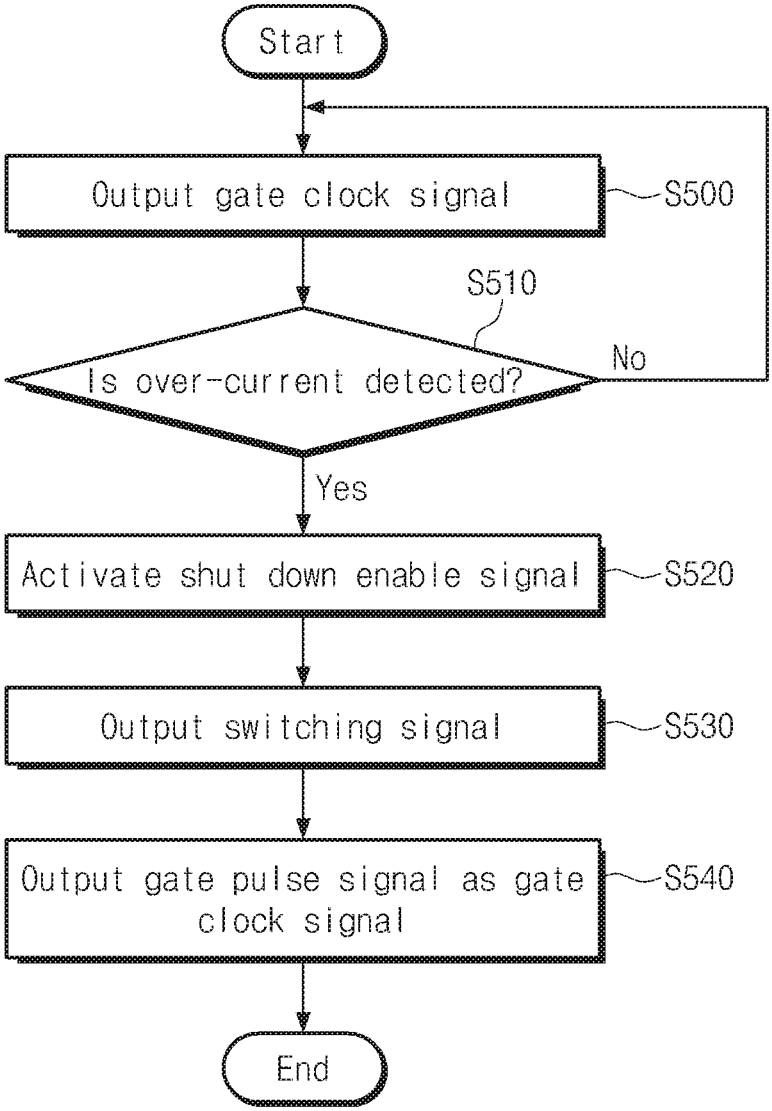
FIG. 8 is a flowchart illustrating an operation of the clock generation circuit of FIG. 6.

FIG. 8 is a flowchart illustrating an operation of the clock generation circuit of FIG. 6.

Referring to FIGS. 6 and 8, during operation S500, the clock generation unit 420 receives the gate pulse signals CPV1 to CPV4 to output the gate clock signals CKV1, CKVB1, CKV2, CKVB2, CKV3, CKVB3, CKV4, and CKVB4.

During operation S510, the over-current protecting unit 440 detects current levels of the gate clock signal lines CLVL1 to CLVL 8. When the current level of each of the gate clock signals is less than the reference level, the over-current protecting unit 440 outputs the shutdown enable signal SH_EN having a low level.

When at least one current level of the gate clock signal lines CLVL1 to CLVL8 is greater than the reference level, the over-current protecting unit 440 outputs the shutdown enable signal SH_EN having a high level. During operation S520, the clock generation unit 420 stops the output of the gate clock signals CKV1, CKVB1, CKV2, CKVB2, CKV3, CKVB3, CKV4, and CKVB4 in response to the shutdown enable signal SH_EN having the high level.

During operation S530, when at least one current level of the gate clock signal lines CLVL1 to CLVL8 is greater than the reference level, the over-current protecting unit 440 sequentially (e.g., successively) activates the switching signals SW1 to SW8 to the high level.

When the switching signals SW1 to SW8 are sequentially (e.g., successively) activated to the high level, the switching transistors STR1 to STR8 of FIG. 7 are sequentially (e.g., successively) turned on. During operation S540, the gate pulse signals CPV1 to CPV4 may be outputted as the corresponding gate clock signals CKV1, CKVB1, CKV2, CKVB2, CKV3, CKVB3, CKV4, and CKVB4.

When the gate driving circuit 100 and/or the display panel DP of FIG. 1 is damaged, over-current may flow through the gate clock signal lines CLVL1 to CLVL8 to which the gate clock signals CKV1, CKVB1, CKV2, CKVB2, CKV3, CKVB3, CKV4, and CKVB4 are provided. When the over-current flowing through the gate clock signals lines CLVL1 to CLVL8 is detected, the clock generation unit 420 may stop the output of the gate clock signals CKV1, CKVB1, CKV2, CKVB2, CKV3, CKVB3, CKV4, and CKVB4 to prevent or substantially prevent the gate driving circuit 100 and/or the display panel DP from malfunctioning and/or being damaged. The gate pulse signals CPV1 to CPV4, each of which has the low voltage level instead of the signal that is swung between the gate on voltage VON and the gate off voltage VOFF, are sequentially (e.g., successively) provided to the gate clock signal lines CLVL1 to CLVL8 to test a function of the gate driving circuit 100.

Figure 9:
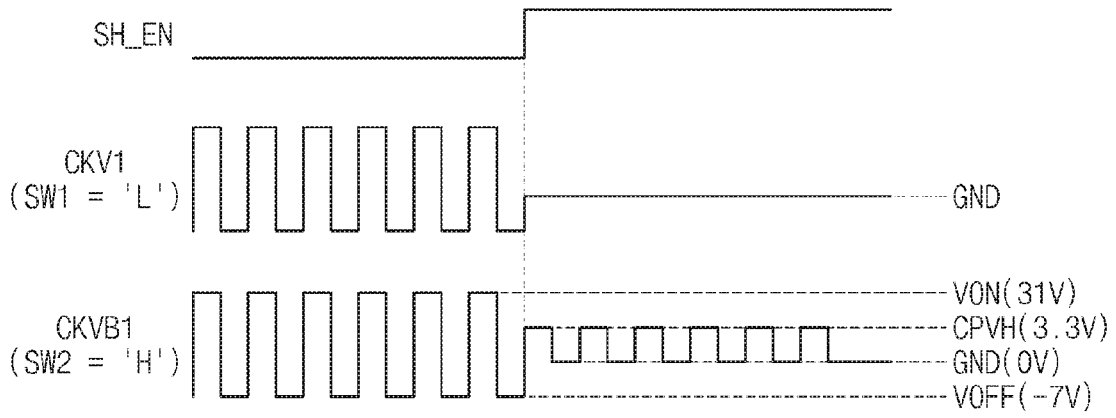
FIG. 9 is a view illustrating an example of waveforms of gate clock signals outputted from the clock generation circuit of FIG. 6.

FIG. 9 is a view illustrating an example of waveforms of the gate clock signals outputted from the clock generation circuit of FIG. 6.

Referring to FIGS. 6 and 9, when the over-current flowing through the gate clock signal lines CLVL1 to CLVL 8 is detected, the over-current protecting unit 440 outputs the shutdown enable signal SH_EN having a high level.

While the shutdown enable signal SH_EN has the high level, the clock generation unit 420 stops the output of the gate clock signals CKV1, CKVB1, CKV2, CKVB2, CKV3, CKVB3, CKV4, and CKVB4. While the shutdown enable signal SH_EN has the high level, the clock generation unit 420 may output the gate clock signals CKV1, CKVB1, CKV2, CKVB2, CKV3, CKVB3, CKV4, and CKVB4, each of which has a level of, for example, a ground voltage GND. Here, when the switching signal SW1 has a low level, the switching transistor STR1 of FIG. 7 is turned off to allow the gate clock signal CKV1 to be maintained or substantially maintained at the ground voltage GND. When the switching signal SW2 has a high level, the switching transistor STR2 of FIG. 7 is turned on to allow the gate pulse signal CPV1 that is swung between a high voltage CPVH and the ground voltage GND to be outputted as the gate clock signal CKVB1.

The gate pulse signal CPV1 that is swung between the high voltage CPVH and the ground voltage GND, instead of the high voltage that is swung between the gate on voltage VON (e.g., about 31 V) and the gate off voltage VOFF (e.g., about −7 V), may be provided as the gate clock signal CKVB1 to test the gate driving circuit 100, while minimizing or reducing an additional damage of the gate driving circuit 100. Also, the switching signals SW1 to SW8 may be sequentially (e.g., successively) activated to the high level to successively output the gate clock signals CKV1, CKVB1, CKV2, CKVB2, CKV3, CKVB3, CKV4, and CKVB4, and a test for determining any gate clock signal line through which the over-current flows from among the gate clock signal lines CLVL1 to CLVL8 may be performed by using a probe.

The clock generation circuit according to one or more of the above-described embodiments may stop the generation of the gate clock signals when the gate clock signals provided to the gate driving circuit has a current level greater than a reference level. When the over-current is detected, the gate pulse signal having a low voltage level may be provided to the gate driving circuit as the gate clock signal to perform a test of the gate driving circuit.

The electronic or electric devices and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

It will be apparent to those skilled in the art that various modifications and changes may be made in the present disclosure. Thus, it is intended that the present disclosure covers the modifications and variations of the inventive concept, provided that they come within the scope of the appended claims and their equivalents. Thus, to the maximum extent allowed by law, the scope of the present invention is to be determined by the broadest permissible interpretation of the following claims and their equivalents, and shall not be restricted or limited by the foregoing detailed description.

What is claimed is:

1. A clock generation circuit comprising:

a clock generator configured to receive a gate pulse signal and to generate at least one gate clock signal corresponding to the gate pulse signal;

an over-current protector configured to detect a current level of the at least one gate clock signal, and to output a shutdown enable signal and at least one switching signal corresponding to the detected current level; and a switching unit comprising at least one switching device configured to output the gate pulse signal as the at least one gate clock signal, wherein the clock generator is configured to generate the at least one gate clock signal in response to the shutdown enable signal, and wherein the at least one switching device is configured to transmit the gate pulse signal as the at least one gate clock signal in response to the at least one switching signal.

2. The clock generation circuit of claim 1, wherein the over-current protector is configured to activate the shutdown enable signal when the detected current level is greater than a reference level.

3. The clock generation circuit of claim 2, wherein the clock generator is configured to stop the generation of the at least one gate clock signal when the shutdown enable signal is activated.

4. The clock generation circuit of claim 2, wherein the over-current protector is configured to activate the at least one switching signal when the shutdown enable signal is activated.

5. The clock generation circuit of claim 1, wherein the clock generator is configured to receive the gate pulse signal to generate a pair of gate clock signals corresponding to the gate pulse signal.

6. The clock generation circuit of claim 5, wherein the over-current protector is configured to output a plurality of switching signals corresponding to the detected current level, and the switching signals respectively correspond to the pair of gate clock signals.

7. The clock generation circuit of claim 6, wherein the over-current protector is configured to sequentially activate the switching signals, when the detected current level exceeds a reference level.

8. The clock generation circuit of claim 1, wherein the at least one switching device comprises a transistor comprising a first electrode connected to receive the gate pulse signal, a second electrode connected to receive the at least one gate clock signal, and a gate electrode connected to receive the at least one switching signal.

9. A method of operating a clock generation circuit, the method comprising:

receiving a gate pulse signal to generate a gate clock signal;

detecting a current level of the gate clock signal;

stopping the generation of the gate clock signal in response to the current level of the gate clock signal being greater than a reference level;

activating a switching signal in response to the current level of the gate clock signal being greater than the reference level; and outputting the gate pulse signal as the gate clock signal in response to the switching signal.

10. The method of claim 9, further comprising activating a shutdown enable signal in response to the current level of the gate clock signal being greater than the reference level.

11. The method of claim 10, wherein the stopping of the generation of the gate clock signal comprises stopping the generation of the gate clock signal in response to the shutdown enable signal being activated.

12. A display device comprising:

a display panel comprising a plurality of pixels connected to a plurality of gate lines and a plurality of data lines, respectively;

a gate driving circuit configured to drive the plurality of gate lines;

a data driving circuit configured to drive the plurality of data lines; and a driving controller configured to control the data driving circuit in response to a control signal and an image signal, and to generate at least one gate clock signal for operating the gate driving circuit, wherein the driving controller comprises:

a timing controller configured to generate a gate pulse signal in response to the control signal; and a clock generation circuit configured to generate the at least one gate clock signal in response to the gate pulse signal, and wherein the clock generation circuit is configured to detect a current level of the at least one gate clock signal, to stop the generation of the at least one gate clock signal when the detected current level is greater than a reference level, and to output the gate pulse signal as the at least one gate clock signal.

13. The display device of claim 12, wherein the clock generation circuit comprises:

a clock generator configured to receive the gate pulse signal and to generate the at least one gate clock signal corresponding to the gate pulse signal;

an over-current protector configured to detect a current level of the at least one gate clock signal, to activate a shutdown enable signal and at least one switching signal when the detected current level is greater than the reference level; and a switching unit comprising at least one switching device configured to output the gate pulse signal as the at least one gate clock signal, wherein the clock generator is configured to generate the at least one gate clock signal in response to the shutdown enable signal, and wherein the at least one switching element is configured to transmit the gate pulse signal as the at least one gate clock signal in response to the at least one switching signal.

14. The display device of claim 13, wherein the clock generator is configured to stop the generation of the at least one gate clock signal when the shutdown enable signal is activated.

15. The display device of claim 13, wherein the over-current protector is configured to activate the at least one switching signal when the shutdown enable signal is activated.

16. The display device of claim 13, wherein the clock generator is configured to receive the gate pulse signal to generate a pair of gate clock signals corresponding to the gate pulse signal.

17. The display device of claim 16, wherein the over-current protector is configured to output a plurality of switching signals corresponding to the detected current level, and the switching signals respectively correspond to the pair of gate clock signals.

18. The display device of claim 17, wherein the switching signals are sequentially activated, when the detected current level exceeds the reference level.

19. The display device of claim 13, wherein the at least one switching device comprises a transistor comprising a first electrode connected to receive the gate pulse signal, a second electrode connected to receive the at least one gate clock signal, and a gate electrode connected to receive the at least one switching signal.

* * * * *